US011479997B2

(12) United States Patent
Hirozawa

(10) Patent No.: US 11,479,997 B2
(45) Date of Patent: Oct. 25, 2022

(54) AUTOMOBILE KEY OPERATION MECHANISM

(71) Applicant: Toyota Jidosha Kabushiki Kaisha, Toyota (JP)

(72) Inventor: Yasunori Hirozawa, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 84 days.

(21) Appl. No.: 16/779,896

(22) Filed: Feb. 3, 2020

(65) Prior Publication Data

US 2020/0263462 A1 Aug. 20, 2020

(30) Foreign Application Priority Data

Feb. 20, 2019 (JP) ..... JP2019-028250

(51) Int. Cl.
*E05B 79/20* (2014.01)
*E05B 85/06* (2014.01)

(52) U.S. Cl.
CPC ..... *E05B 85/06* (2013.01); *E05B 79/20* (2013.01)

(58) Field of Classification Search
CPC ..... E05B 79/10; E05B 79/12; E05B 79/16
USPC ..... 70/240, 256
See application file for complete search history.

(56) References Cited

U.S. PATENT DOCUMENTS 1,652,953 A * 12/1927 Patterson ..... B60R 25/04 70/217
2,202,834 A * 6/1940 Clarkson-Jones ..... E05B 77/46 70/264
4,342,209 A * 8/1982 Kleefeldt ..... E05B 77/48 292/DIG. 25
5,511,838 A * 4/1996 Baughman ..... E05B 81/25 292/201
5,638,712 A * 6/1997 Kuroda ..... B60R 25/04 70/264

(Continued)

FOREIGN PATENT DOCUMENTS

DE 102009025751 A1 11/2010
GB 2271374 A 4/1994

(Continued)

OTHER PUBLICATIONS

Definition of "line," https://www.dictionary.com/browse/line (Year: 2022).*

*Primary Examiner* — Alyson M Merlino
(74) *Attorney, Agent, or Firm* — Dinsmore & Shohl LLP

(57) ABSTRACT

A key operation mechanism includes a key cylinder; a locking lever that extends from a side surface of the key cylinder; and an unlocking lever that extends from a side surface of the key cylinder in a direction that is different from the direction in which the locking lever extends. The key operation mechanism further includes a locking pull line that is configured to lock a door and an unlocking pull line that is configured to unlock the door. One end of the locking pull line is attached to the locking lever, and one end of the unlocking pull line is attached to the unlocking lever. When the key cylinder rotates in a locking direction, the locking lever pulls the locking pull line, and, when the key cylinder rotates in an unlocking direction that is opposite the locking direction, the unlocking lever pulls the unlocking pull line.

4 Claims, 5 Drawing Sheets

(56) References Cited

U.S. PATENT DOCUMENTS

| | | | | | |
|---|---|---|---|---|---|
| 5,832,757 | A * | 11/1998 | Chikata | E05B 79/20 | 70/210 |
| 5,947,536 | A * | 9/1999 | Mizuki | E05B 79/20 | 292/201 |
| 7,040,675 | B1 * | 5/2006 | Ott | B60J 7/19 | 292/123 |
| 7,343,762 | B1 * | 3/2008 | East | E05B 13/108 | 292/36 |
| 7,547,056 | B2 * | 6/2009 | Waldner | E05B 79/20 | 292/DIG. 43 |
| 8,936,284 | B2 * | 1/2015 | Konchan | E05B 83/36 | 292/201 |
| 10,005,510 | B2 * | 6/2018 | Nishida | E05B 83/16 | |
| 10,966,520 | B2 * | 4/2021 | Chen | E05B 53/003 | |
| 2009/0107194 | A1 * | 4/2009 | Tamezane | E05B 17/04 | 70/379 R |

FOREIGN PATENT DOCUMENTS

| | | | | |
|---|---|---|---|---|
| GB | 2465864 | A * | 6/2010 | E05B 17/0058 |
| JP | H10-205189 | A | 8/1998 | |
| JP | 2005-088711 | A | 4/2005 | |
| JP | 2017-082459 | A | 5/2017 | |

* cited by examiner

AUTOMOBILE KEY OPERATION MECHANISM

CROSS REFERENCE TO RELATED APPLICATION

This application claims priority to Japanese Patent Application No. 2019-028250 filed on Feb. 20, 2019, which is incorporated herein by reference in its entirety including the specification, claims, drawings, and abstract.

TECHNICAL FIELD

The present disclosure relates to an automobile key operation mechanism and, in particular, to a mechanism that includes a key cylinder.

BACKGROUND

Research and development on automobile doors is widely under way. A typical door of an automobile includes a door latch, and the door is closed as the door latch hooks on to the body of the vehicle. As a door handle associated with the door latch is operated by a passenger, the door latch is unhooked from the body of the vehicle, and the door is opened. The door latch has a corresponding key cylinder, and, in response to insertion and rotation of a key in the key cylinder by a passenger, the door latch and the door are unlocked or locked.

JP 2017-82459 A discloses an automobile door lock system. This system includes a plurality of levers and causes a rotational force to successively act upon adjacent levers to thereby transmit the rotational force from the key cylinder to a locking mechanism for locking the door latch. JP 2005-88711 A discloses a canopy door to which the present disclosure is applicable. A canopy door is a type of door that opens and closes as a portion extending from the front and side windows of an automobile to the ceiling is moved.

SUMMARY

A typical automobile includes a key cylinder near a door latch that includes a locking mechanism. Examples of the mechanism that transmits the rotational force from the key cylinder to the locking mechanism include a mechanism that includes a plurality of levers as disclosed in, for example, JP 2017-82459 A. In recent years, various structures of automobile doors or bodies are under consideration, and a structure in which a key cylinder and a door latch are disposed away from each other is also being contemplated. In such a structure, to transmit the rotational force from the key cylinder only via a plurality of levers, the mechanism interposed between the key cylinder and the door latch may be complicated.

The present disclosure is directed toward simplifying the structure of an automobile key operation mechanism.

According to one aspect of the present disclosure, there is provided an automobile key operation mechanism. The automobile key operation mechanism comprises a key cylinder; a locking lever that extends from a side surface of the key cylinder; an unlocking lever that extends from a side surface of the key cylinder in a direction that is different from the direction in which the locking lever extends; a locking pull line that is configured to lock a door of an automobile; and an unlocking pull line that is configured to unlock the door. One end of the locking pull line is attached to the locking lever, and one end of the unlocking pull line is attached to the unlocking lever. When the key cylinder rotates in a locking direction, the locking lever pulls the locking pull line, and, when the key cylinder rotates in an unlocking direction that is opposite the locking direction, the unlocking lever pulls the unlocking pull line.

In an embodiment, the automobile key operation mechanism further comprises a support component. When the key cylinder rotates in the locking direction, the support component supports the locking pull line at a position at which the locking lever is at a greater distance away from the support component, and, when the key cylinder rotates in the unlocking direction, the support component supports the unlocking pull line at a position at which the unlocking lever is at a greater distance away from the support component.

In an embodiment, the locking lever has a locking pull line insertion hole through which the locking pull line passes in a freely slidable manner. The locking pull line that passes through the locking pull line insertion hole has a locking pull line stopper that does not pass through the locking pull line insertion hole. The unlocking lever has an unlocking pull line insertion hole through which the unlocking pull line passes in a freely slidable manner. The unlocking pull line that passes through the unlocking pull line insertion hole has an unlocking pull line stopper that does not pass through the unlocking pull line insertion hole.

The present disclosure enables a simplified structure of an automobile key operation mechanism.

BRIEF DESCRIPTION OF DRAWINGS

Embodiments of the present disclosure will be described based on the following figures, wherein.

DESCRIPTION OF EMBODIMENTS

Figure 1:
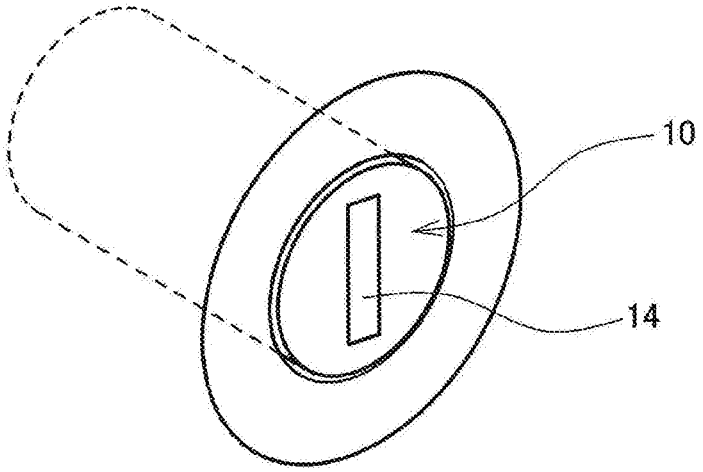
FIG. 1 illustrates a perspective view of a key cylinder.

An automobile key operation mechanism according to an embodiment of the present disclosure will be described below with reference to the drawings. In the following description, unless otherwise specified, the terms up/down and right/left represent directions as viewed in the drawings. The same components illustrated in two or more drawings are denoted by the same reference numerals, and the same description is not repeated.

FIG. 1 illustrates a perspective view of a key cylinder 10 that is attached to an automobile. The key cylinder 10 has a generally cylindrical column shape and is attached to an automobile with one end facing toward the outside. The surface of the end of the key cylinder 10 facing toward the outside of the automobile has a key hole 14 that extends therefrom toward the inside of the automobile. Insertion of a key that fits the key hole 14 into the key hole 14 enables the key cylinder 10 to rotate freely along with the key. For example, the door is locked by a locking operation in which the key cylinder 10 is rotated clockwise, and the door is unlocked by an unlocking operation in which the key cylinder 10 is rotated counterclockwise.

Figure 2:
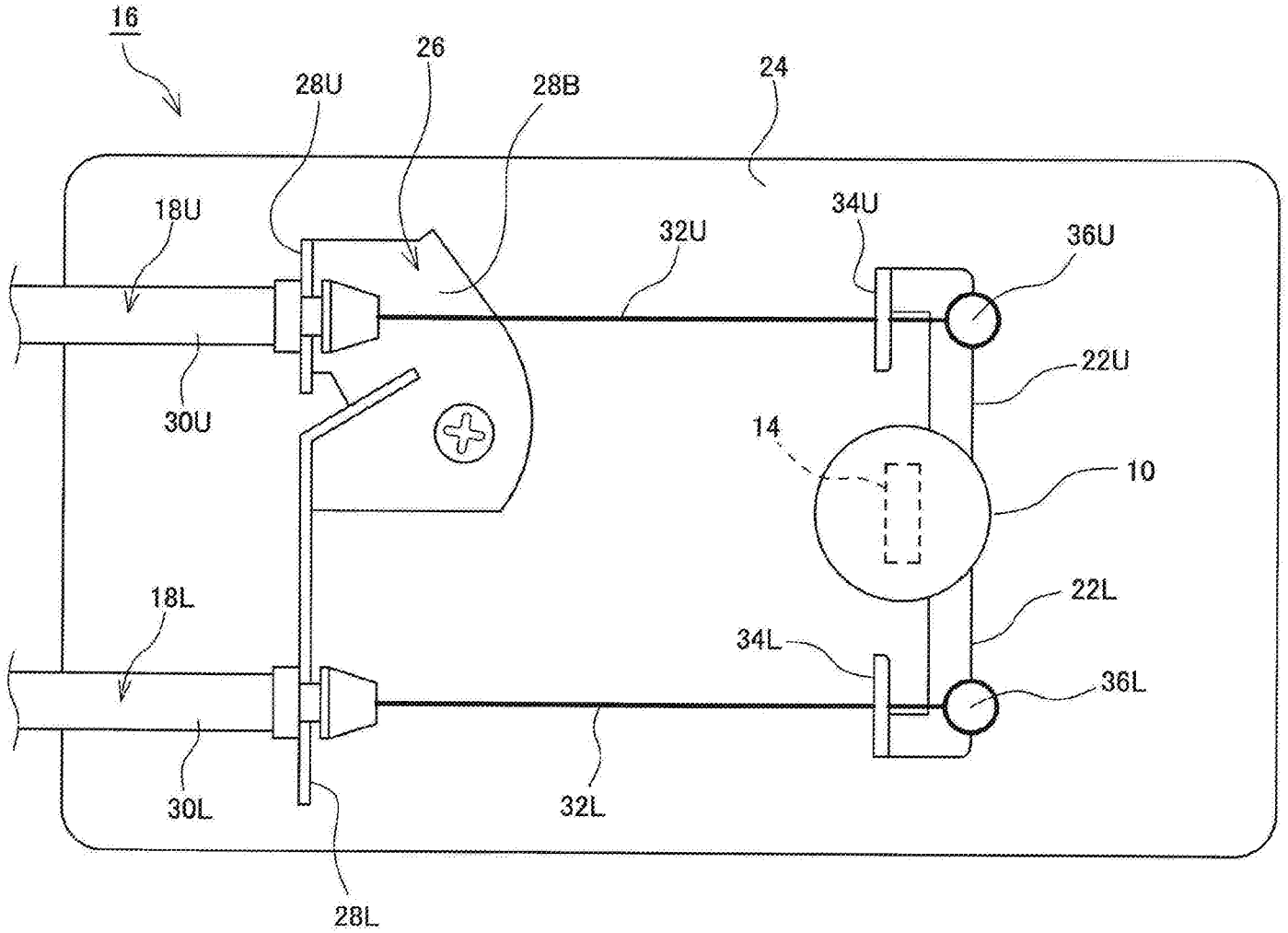
FIG. 2 schematically illustrates a key operation mechanism that is in a neutral state.

FIG. 2 schematically illustrates a key operation mechanism 16 that includes the key cylinder 10 and its surrounding mechanism. This figure illustrates the key operation mechanism 16 as viewed from the inside of the automobile looking out, and the direction toward the drawing plane corresponds to the direction toward the outside of the automobile. This figure illustrates the key operation mechanism 16 that is in a neutral state in which the key operation mechanism 16 is in neither a locking operation state nor an unlocking operation state.

An unlocking cable 18U and a locking cable 18L that lead to a locking mechanism of a door latch extend from the key operation mechanism 16. Each of these cables includes a pull line (inner cable) 32L or 32U that is inserted through a flexible cable tube that is formed from, for example, a plastic resin. The pull lines 32L and 32U may be made of metal or another material such as a plastic resin or natural fiber that is formed in a linear shape. The locking cable 18L is configured to lock the door, and the unlocking cable 18U is configured to unlock the door.

Specifically, the locking cable 18L brings the locking mechanism into a locked state as one end of the pull line 32L that is connected to the key operation mechanism 16 is pulled, and as a force created by the pulling is transmitted to the locking mechanism that is located on the other end. The unlocking cable 18U brings the locking mechanism into an unlocked state as one end of the pull line 32U that is located closer to the key operation mechanism 16 is pulled, and as a force created by the pulling is transmitted to the locking mechanism that is located on the other end.

The key operation mechanism 16 includes a locking lever 22L that extends downward from a side surface of the key cylinder 10 and an unlocking lever 22U that extends upward from a side surface of the key cylinder 10. The locking lever 22L and the unlocking lever 22U may be formed integrally from the same material as the key cylinder 10. The locking lever 22L and the unlocking lever 22U are located on a straight line that passes vertically through the key cylinder 10, further toward the right than the central axis of the key cylinder 10.

In some embodiments, the locking lever 22L and the unlocking lever 22U may be located either on a straight line that passes vertically through the key cylinder 10, further toward the left than the central axis of the key cylinder 10 or on a straight line that vertically intersects the central axis of the key cylinder 10. In other embodiments, the locking lever 22L and the unlocking lever 22U are not located on a straight line and may extend from a side surface of the key cylinder 10 in different directions from each other.

A cable bracket 26 is fixed to a housing 24. The cable bracket 26 includes a base plate 28B that is screwed to an inner surface of the housing 24, and further includes an unlocking cable mounting wall 28U and a locking cable mounting wall 28L, both projecting from the base plate 28B toward the inside of the automobile. The locking cable mounting wall 28L extends diagonally downward toward the left below the unlocking cable mounting wall 28U, and then further extends downward to protrude from the base plate 28B.

A tip portion of a locking cable tube 30L that is included in the locking cable 18L is fixed to the locking cable mounting wall 28L near its lower end. A tip portion of an unlocking cable tube 30U that is included in the unlocking cable 18U is fixed to the unlocking cable mounting wall 28U. As such, when the key cylinder 10 rotates counterclockwise as viewed in the figure (locking direction), the cable bracket 26 serving as a support component supports the locking pull line 32L on the housing 24 at a position at which the locking lever 22L is at a greater distance away from the cable bracket 26. When the key cylinder 10 rotates clockwise as viewed in the figure (unlocking direction), the cable bracket 26 supports the unlocking pull line 32U on the housing 24 at a position at which the unlocking lever 22U is at a greater distance away from the cable bracket 26.

The locking lever 22L extends downward from the key cylinder 10 and then bends toward the left, and the left side of the central axis of the key cylinder 10 is located above the terminating end of the locking lever 22L. A pull line mounting wall 34L projects from the terminating end of the locking lever 22L, and the locking pull line 32L that is exposed from the locking cable tube 30L passes through a pull line insertion hole in the pull line mounting wall 34L in a freely slidable manner. The tip of the locking pull line 32L has a locking pull line stopper 36L that has a spherical shape. The locking pull line stopper 36L may have any shape that is sized so as not to pass through the pull line insertion hole. When the key cylinder 10 rotates counterclockwise as viewed in the figure, as the locking pull line stopper 36L is caught by the right side surface of the pull line mounting wall 34L, the locking pull line 32L is pulled toward the right.

The unlocking lever 22U has a structure similar to that of the locking lever 22L. The unlocking pull line 32U that is exposed from the unlocking cable tube 30U passes through a pull line insertion hole in a pull line mounting wall 34U of the unlocking lever 22U in a freely slidable manner. The tip of the unlocking pull line 32U has an unlocking pull line stopper 36U that is similar to the locking pull line stopper 36L. When the key cylinder 10 rotates clockwise as viewed in the figure, as the unlocking pull line stopper 36U is caught by the right side surface of the pull line mounting wall 34U, the unlocking pull line 32U is pulled toward the right.

Figure 3:
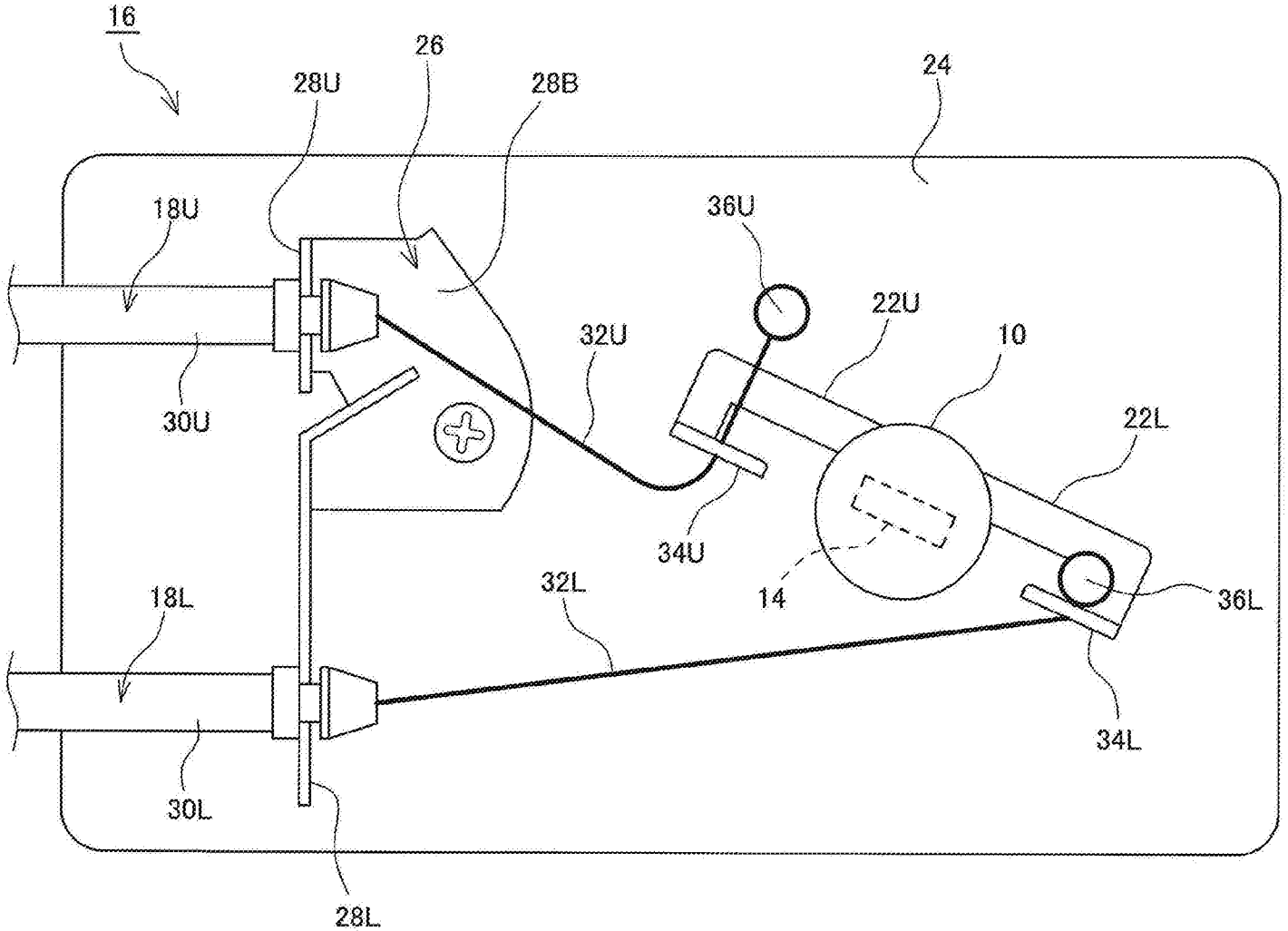
FIG. 3 schematically illustrates the key operation mechanism that is in a locking operation state.

FIG. 3 illustrates the key operation mechanism 16 that is in a locking operation state. In the locking operation state, the key cylinder 10 has been rotated counterclockwise as viewed in the figure. The locking pull line 32L is pulled toward the right by the locking lever 22L. In response to the pulling of the locking pull line 32L, the locking mechanism to which the locking cable 18L and the unlocking cable 18U lead locks the door latch.

On the other hand, the unlocking pull line 32U extends into the pull line insertion hole in the pull line mounting wall 34U of the unlocking lever 22U and is curved loosely. This is because the length of the unlocking pull line 32U that is exposed from the unlocking cable tube 30U is longer than the distance between the tip of the unlocking cable tube 30U and the pull line mounting wall 34U.

As described above, the unlocking pull line 32U is freely slidable through the pull line insertion hole in the pull line mounting wall 34U of the unlocking lever 22U. This configuration avoids the unlocking pull line 32U from interfering with movement of the key cylinder 10.

Figure 4:
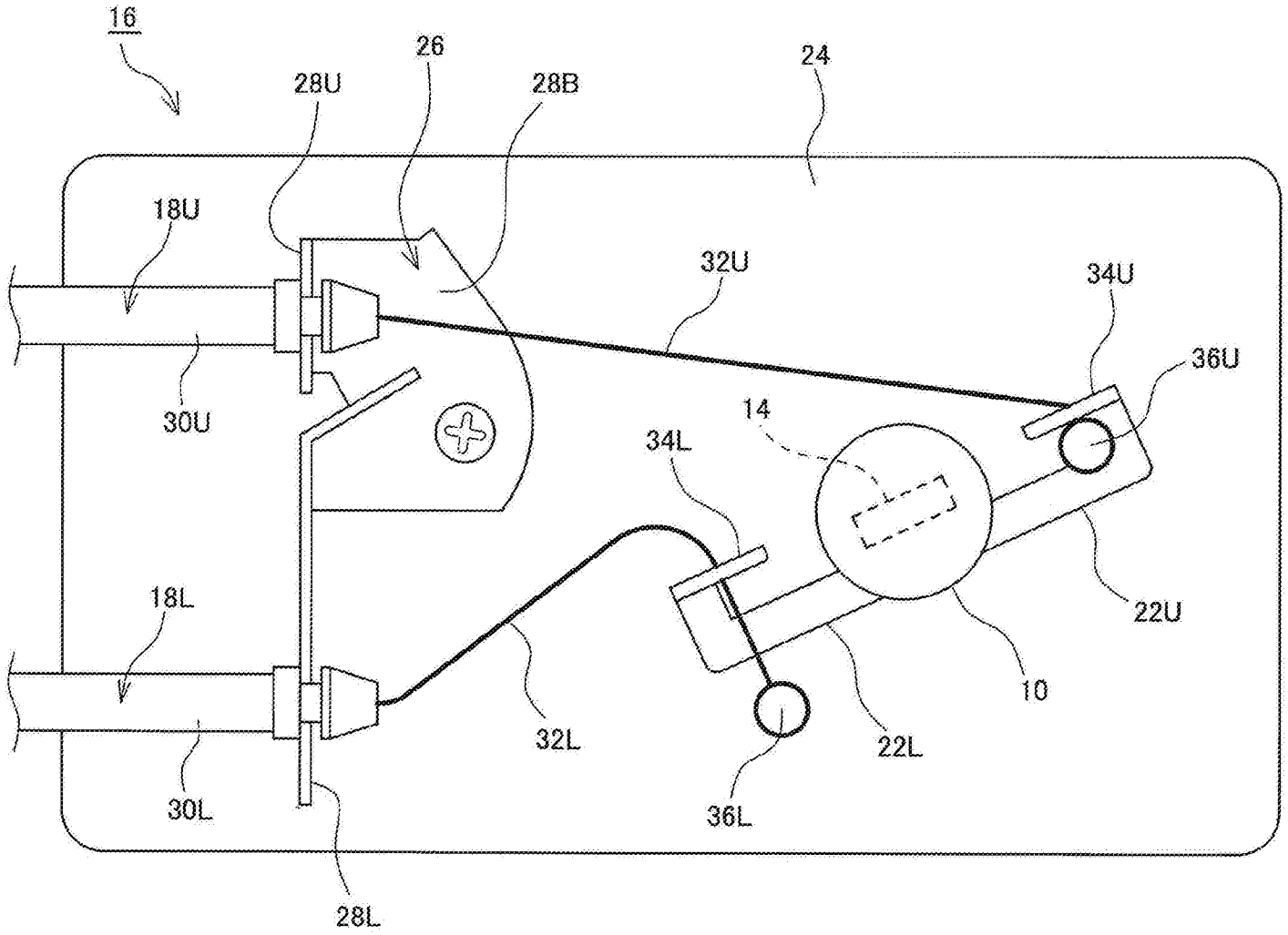
FIG. 4 schematically illustrates the key operation mechanism that is in an unlocking operation state.

FIG. 4 illustrates the key operation mechanism 16 that is in an unlocking operation state. In the unlocking operation state, the key cylinder 10 has been rotated clockwise as viewed in the figure. The unlocking pull line 32U is pulled toward the right by the unlocking lever 22U. In response to the pulling of the unlocking pull line 32U, the locking mechanism to which the locking cable 18L and the unlocking cable 18U lead unlocks the door latch.

On the other hand, according to principles similar to those of the unlocking pull line 32U in the locking operation state, the locking pull line 32L extends into the pull line insertion hole in the pull line mounting wall 34L of the locking lever 22L and is curved loosely.

As described above, the locking pull line 32L is freely slidable through the pull line insertion hole in the pull line mounting wall 34L of the locking lever 22L. This configuration avoids the locking pull line 32L from interfering with movement of the key cylinder 10.

The key cylinder 10 may include a biasing mechanism that holds the key cylinder 10 in the neutral state by a spring. With the biasing mechanism, the key cylinder 10 is biased from the locking operation state to the neutral state as a rotational force applied to a key that is inserted into the key hole 14 is relaxed by the passenger when the key cylinder 10 is in the locking operation state. Similarly, the key cylinder 10 is biased from the unlocking operation state to the neutral state as a rotational force applied to a key that is inserted into the key hole 14 is relaxed by the passenger when the key cylinder 10 is in the unlocking operation state.

In the above-described embodiment, the locking lever 22L is disposed below the key cylinder 10, and the unlocking lever 22U is disposed above the key cylinder 10. In another embodiment, the locking lever 22L may be disposed above the key cylinder 10, and the unlocking lever 22U may be disposed below the key cylinder 10. The locking pull line 32L and the unlocking pull line 32U are then disposed in a vertically opposite arrangement, and the key cylinder 10 is rotated in opposite directions when it is rotated in the locking direction and in the unlocking direction.

Figure 5:
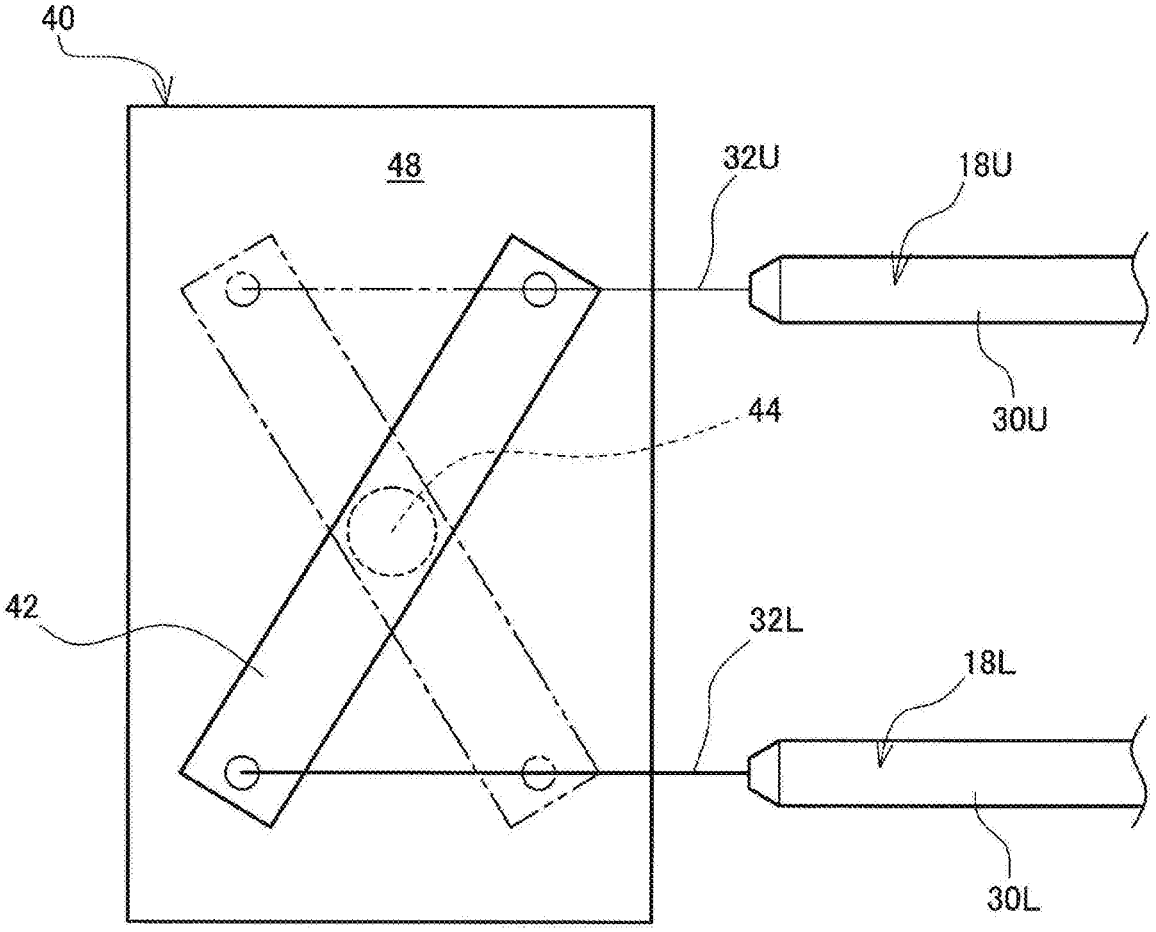
FIG. 5 schematically illustrates a locking mechanism.

FIG. 5 schematically illustrates an example of a locking mechanism 40. The locking mechanism 40 includes a rotation lever 42 and a main mechanism 48. In FIG. 5, the rotation lever 42 that is in an unlocked state is illustrated by solid lines, and the rotation lever 42 that is in a locked state is illustrated by chain double-dashed lines. A shaft 44 projects from the center of the rotation lever 42 to the main mechanism 48. The locking pull line 32L that is exposed from the locking cable tube 30L is fixed to a lower end portion of the rotation lever 42. The unlocking pull line 32U that is exposed from the unlocking cable tube 30U is fixed to an upper end portion of the rotation lever 42.

A locking operation in the key operation mechanism 16 causes the locking pull line 32L to be pulled toward the right as viewed in the figure. In response, the rotation lever 42 rotates counterclockwise, and a rotational force transmitted by the shaft 44 causes the main mechanism 48 to lock the door latch. An unlocking operation in the key operation mechanism 16 causes the unlocking pull line 32U to be pulled toward the right as viewed in the figure. In response, the rotation lever 42 rotates clockwise, and a rotational force transmitted by the shaft 44 causes the main mechanism 48 to unlock the door latch.

The main mechanism 48 may hold the rotation lever 42 at a locking position at which the rotation lever 42 has rotated completely counterclockwise and may hold the rotation lever 42 at an unlocking position at which the rotation lever 42 has rotated completely clockwise. The main mechanism 48 may bias the rotation lever 42 when a force of the locking pull line 32L or the unlocking pull line 32U that pulls the rotation lever 42 is relaxed, to hold the rotation lever 42 in the neutral position that is halfway between the locking position and the unlocking position.

The main mechanism 48 may include a mechanism that includes a lever fixed to the shaft 44 such that the lever locks or unlocks the door latch by a rotational force applied to the shaft 44. The mechanism for transmitting a rotational force from the rotation lever 42 to the main mechanism 48 is not limited to the shaft 44 and may be implemented by using, for example, a lever that, as forces from this lever and the rotation lever 42 act upon each other, swings in response to a force applied from the rotation lever 42.

The above-described embodiment employs cables each including a pull line that is inserted through a flexible tube. In some embodiments, the pull line of the cable is not covered by the tube throughout all segments of the pull line; in other words, the tube of the cable may include a segment where the pull line is exposed. Alternatively, there may be used a cable including a pull line that is inserted through a plurality of annular components that are disposed at predetermined intervals.

In the key operation mechanism 16 according to the illustrated embodiment, the key cylinder 10 and the locking mechanism 40 are connected by cables. Therefore, the mechanism between the key cylinder 10 and the locking mechanism 40 is simple even if the distance between the locking mechanism 40 and the key cylinder 10 is long or even if the locking mechanism 40 is disposed at a position in a complicated structure that is difficult to reach as viewed from the key cylinder 10.

The key operation mechanism 16 converts a locking direction rotational force that is applied to the key cylinder 10 into a force that pulls the locking pull line 32L and converts an unlocking direction rotational force that is applied to the key cylinder 10 into a force that pulls the unlocking pull line 32U. Therefore, as two locking and unlocking cables share the single key cylinder 10, the structure of the key operation mechanism 16 is simplified.

The key operation mechanism 16 according to the illustrated embodiment may be used for a canopy door of an automobile that opens and closes as a portion extending from the front and side windows to the ceiling is moved. A canopy door, which is attached to the body of a vehicle at the front via a rotary mechanism, opens and closes as it rotates vertically about the rotary mechanism. JP 2005-88711 A described above discloses a single-seat compact automobile that has a canopy door.

In recent years, research and development is under way to upsize automobiles with canopy doors. A canopy door spans from side to side of the body of the vehicle, and as such, the upsizing of automobiles also upsizes canopy doors. An idea to allow for such structures is to increase the mechanical strength of a canopy door as measured when it is closed, by providing door latches on the body of the vehicle on right and left sides of the canopy door. Further, another mechanism is also being contemplated. A single locking mechanism that is mechanically connected to the two right and left door latches by cables is disposed in the body of the vehicle, and the right and left door latches are locked or unlocked by this locking mechanism. By using the key operation mechanism according to the illustrated embodiment for such a locking mechanism that is disposed in the body of the vehicle, the mechanism interposed between the key cylinder and the locking mechanism can be simplified.

The invention claimed is:

1. An automobile key operation mechanism comprising:

a key cylinder;

a locking lever that extends from a side surface of the key cylinder;

an unlocking lever that extends from the side surface of the key cylinder in a direction that is different from a direction in which the locking lever extends;

a locking pull line that is configured to lock a door of an automobile; and an unlocking pull line that is configured to unlock the door, wherein one end of the locking pull line is coupled to the locking lever, wherein one end of the unlocking pull line is coupled to the unlocking lever, and wherein, when the key cylinder rotates in a locking direction, the locking lever pulls the locking pull line, and, when the key cylinder rotates in an unlocking direction that is opposite the locking direction, the unlocking lever pulls the unlocking pull line, wherein the locking lever has a locking pull line insertion hole through which the locking pull line passes in a freely slidable manner during the rotation of the key cylinder in the unlocking direction, wherein the locking pull line that passes through the locking pull line insertion hole has a locking pull line stopper that does not pass through the locking pull line insertion hole, wherein the unlocking lever has an unlocking pull line insertion hole through which the unlocking pull line passes in a freely slidable manner during the rotation of the key cylinder in the locking direction, and wherein the unlocking pull line that passes through the unlocking pull line insertion hole has an unlocking pull line stopper that does not pass through the unlocking pull line insertion hole.

2. The automobile key operation mechanism according to claim 1, further comprising a support component that, when the key cylinder rotates in the locking direction, supports the locking pull line at a position at which the locking lever is at a greater distance away from the support component, and, when the key cylinder rotates in the unlocking direction, supports the unlocking pull line at a position at which the unlocking lever is at a greater distance away from the support component.

3. An automobile key operation mechanism comprising:

a key cylinder;

a locking lever that extends from a side surface of the key cylinder;

an unlocking lever that extends from the side surface of the key cylinder in a direction that is different from a direction in which the locking lever extends;

a locking pull line that is configured to lock a door of an automobile; and an unlocking pull line that is configured to unlock the door, wherein one end of the locking pull line is coupled to the locking lever, wherein one end of the unlocking pull line is coupled to the unlocking lever, and wherein, when the key cylinder rotates in a locking direction, the locking lever pulls the locking pull line, and, when the key cylinder rotates in an unlocking direction that is opposite the locking direction, the unlocking lever pulls the unlocking pull line, wherein the locking lever has a locking pull line insertion hole through which the locking pull line passes in a freely slidable manner, wherein the locking pull line that passes through the locking pull line insertion hole has a locking pull line stopper that does not pass through the locking pull line insertion hole, wherein the unlocking lever has an unlocking pull line insertion hole through which the unlocking pull line passes in a freely slidable manner, wherein the unlocking pull line that passes through the unlocking pull line insertion hole has an unlocking pull line stopper that does not pass through the unlocking pull line insertion hole, the locking lever includes a pull line mounting wall with a side surface, the locking pull line stopper is caught by the side surface of the pull line mounting wall when the key cylinder rotates in the locking direction, and the unlocking lever includes a pull line mounting wall with a side surface, the unlocking pull line stopper is caught by the side surface of the pull line mounting wall when the key cylinder rotates in the unlocking direction.

4. The automobile key operation mechanism according to claim 3, further comprising a support component that, when the key cylinder rotates in the locking direction, supports the locking pull line at a position at which the locking lever is at a greater distance away from the support component, and, when the key cylinder rotates in the unlocking direction, supports the unlocking pull line at a position at which the unlocking lever is at a greater distance away from the support component.

* * * * *